US006206082B1

(12) United States Patent
Naito

(10) Patent No.: US 6,206,082 B1
(45) **Date of Patent: *Mar. 27, 2001**

(54) MOLDING MACHINE AND METHOD TO PREVENT A FLASK FROM DEFORMING

(75) Inventor: Masamoto Naito, Toyohashi (JP)

(73) Assignee: Sintokogio, Ltd., Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/064,322

(22) Filed: Apr. 22, 1998

(51) Int. Cl.[7] ..... B22C 21/14

(52) U.S. Cl. ..... 164/379; 164/411; 164/394; 164/207

(58) Field of Search ..... 164/37, 379, 411, 164/207, 394, 170

(56) References Cited

U.S. PATENT DOCUMENTS 939,849 * 11/1909 Millar ..... 164/379
4,063,586 * 12/1977 Keller ..... 164/379
4,351,098 * 9/1982 Hanna ..... 164/411

FOREIGN PATENT DOCUMENTS 55-154652 U 11/1980 (JP) .
55-154655 U 11/1980 (JP) .
10-146648 6/1998 (JP) .
619279 * 8/1978 (SU) ..... 164/379

* cited by examiner

*Primary Examiner*—Harold Pyon
*Assistant Examiner*—I.-H. Lin
(74) *Attorney, Agent, or Firm*—Limbach & Limbach L.L.P.

(57) ABSTRACT

A molding machine for producing a mold by applying external force of either pressurized air or mechanical compaction or both to molding sand (12) that is held in a mold space is disclosed. The mold space is defined by a master plate (9), which has a pattern (8), and a flask (7). The molding machine includes a lifter table (11) for vertically carrying the master plate (9) and the flask (7), a filling frame (4) disposed for vertical movement above the lifter table (10), and a reinforcing frame (5) disposed for vertical movement between the filling frame (4) and the lifter table (10). The reinforcing frame (5) and the flask (7) are adapted to approach each other such that the reinforcing frame (5) contacts the outer surface of the flask (7) to reinforce it.

3 Claims, 3 Drawing Sheets

MOLDING MACHINE AND METHOD TO PREVENT A FLASK FROM DEFORMING

FIELD OF THE INVENTION

This invention relates to a molding machine and method wherein a flask and the like are used, and wherein the flask is prevented from being deformed.

DESCRIPTION OF THE PRIOR ART

In conventional molding machines such as an airflow and press molding machine and an air impact molding machine, wherein molding sand is introduced into a flask first, and then a mold space that is defined by the flask and the like is closed, and pressurized air is introduced into the mold space, applying a high pressure to the mold space, for example 0.3 MPa, which is greater than the atmospheric pressure, is necessary. Further, in a conventional molding machine that compacts the molding sand by mechanical force such as a squeeze force, the squeeze output force of the machine sometimes exeeds 1.5 MPa. Thus the pressures to be used in such molding machines have been becoming great.

These molding machines use such high pressures so as to produce molds that have high strength (i.e., high bulk density). However, since these high pressures impart a large force to the flask, it must have a large section in size to prevent it from being deformed. If the flask is deformed, the mold would collapse when the flask is removed from it, or the mold cavity would be deformed. This would result in the size of the mold being inaccurate.

By the way, when a molding machine is used with such a high pressure, and when new facilities that includes this machine and some new flasks are manufactured or obtained, each flask can be one that has a high strength. However, when a conventional, old-type molding line and old-type flasks are used, and when a new air impact molding machine is used instead of the conventional molding machine, the above-mentioned pressurized air or mechanical force cannot be used due to the low strength of the flasks. Thus a mold that has a high bulk density cannot be obtained, or sometimes the desired effect cannot be obtained.

Further, if small, lightweight flasks are used in new facilities, the money to be invested in the transferring facilities of the molding line will be reduced, the energy to be used will be reduced, and the life of the transferring facilities, which is affected by friction, etc., will become long.

The present invention aims to provide a molding method and machine wherein a weak flask, which receives a large force when a mold is produced in it, is prevented from being deformed, or wherein a weak, lightweight metal flask which may be used safely in any line other than a molding line, but which may not be used in a molding line because it is deformed during the molding process, is prevented from being deformed even in the molding process.

SUMMARY OF THE INVENTION

In the method of the present invention, a weak, lightweight flask is encased in a reinforcing means such as a reinforcing frame that reinforces the flask at least when a mold is produced or molding sand is compacted. This prevents the flask from being deformed.

The molding machine of the present invention is one that produces a mold by applying external force of at least one of a pressurized airflow and mechanical compaction to molding sand that is fed into a mold space. The mold space is defined by a flask and a master plate provided with a pattern. The molding machine includes a lifter table for vertically carrying the master plate and the flask, a filling frame that is vertically movable above the lifter table and that comes into contact with the top of the flask, and a reinforcing frame that is vertically movable below the flask. The reinforcing frame and the flask relatively approach each other so that the reinforcing frame contacts the outer surface of the flask to reinforce the flask.

This invention enables molding machines such as an airflow and press molding machine, which provides a mold that has a high bulk density, and that can produce a high-quality cast, to be incorporated in conventional facilities.

Further, this invention enables such facilities to use lightweight, small flasks, so that the money to be invested in the transferring system of such facilities and the energy used in the facilities can be reduced, and so that the life of the facilities, which is affected by inherent friction, etc., will become long.

In this invention, producing a mold using a flask and the like means producing a mold wherein pressurized air is introduced from an air tank of an airflow and press molding machine or an air impact molding machine into a mold space defined by the flask and the like to compact molding sand in the mold space. It also means producing a mold wherein the molding sand is further compacted after such an airflow introduction by a mechanical force such as squeezing force. It also means producing a mold wherein molding sand in the mold space is compacted only by mechanical force. A squeezing force is a typical example of a mechanical force. Thus the mechanical force is not limited to it.

Further, the reinforcing frame, which is an example of reinforcing means, preferably has an inner surface shape that is similar to the outer surface shape of the flask. The material of the frame is preferably metal, because it wears less than other materials. However, the frame is not limited to metal, and it may be of any material, if it has enough strength.

The frame preferably has a strength greater than that of the flask, in order to resist the force that is imparted to the flask while a mold is produced. Alternatively, the assembly of the frame and the flask may have enough strength to resist that force. More preferably, the frame has a strength greater than the pressure that the molding machine uses to produce a mold. If it has such a strength, the flask held in it will not be deformed. When the weight of the flask is a problem, the strength of the assembly or combination of the flask and the frame is made to be greater than that of the force used by the machine.

DESCRIPTION OF THE PREFERRED EMBODIMENTS

Figure 1:
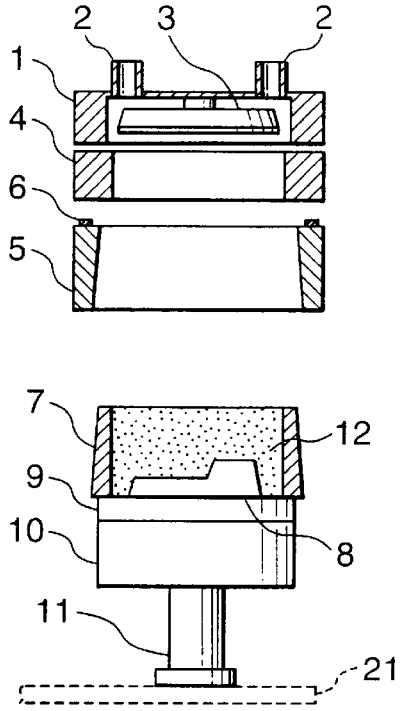
FIG. 1 is an explanatory cross-sectional view of a molding machine of an embodiment of the invention wherein it is shown just before a mold is produced.
Figure 2:
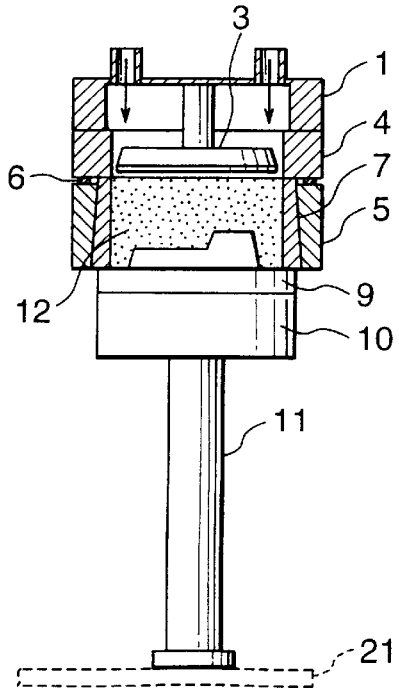
FIG. 2 is an explanatory cross-sectional view of the molding machine of FIG. 1 wherein it is shown producing a mold.

The preferred embodiments are now explained by reference to the accompanying drawings. FIGS. 1 and 2 show a first embodiment. In FIG. 1, a part of a molding machine, i.e., some elements such as a cover-like, cup-shaped, mold-space-forming member 1, a filling frame 4, and a reinforcing frame 5 which acts as means for reinforcing a flask 7, are shown. These elements 1, 4, 5 are supported by a frame which is not shown so that the elements can be clearly seen. The filling frame 4 and the reinforcing frame 5 are supported by the frame (not shown) such that they can move upward when pushed up. A plurality of air-introducing pipes 2 are provided on the mold-space-forming member 1, and they are in fluid communication with an air tank (not shown) to introduce pressurized air from the tank to a mold space. Also, a squeeze board 3, which is operated by a squeezing device (not shown) is disposed in the member 1 for vertical movement.

Below the cover-like member 1, the filling frame 4 is disposed for vertical movement. Below the filling frame 4, the reinforcing frame 5, which acts as a reinforcing means, is disposed for vertical movement. A cushion pad 6 is attached to the top of the reinforcing frame 5. The inner surface of the reinforcing frame 5 is inclined or tapered, and the outer surface of every flask 7 that is used in the molding machine is also inclined or tapered and sized such that it fits in the reinforcing frame 5.

Other than when a mold is produced, that is, when a flask 7 which holds a mold (i.e., molding sand that has been compacted) is replaced by a new, empty flask before a mold is produced in it, the flask 7 and the frame 5 are separated while the flask is transferred. In other words, the molding machine has the reinforcing frame 5. Each of a plurality of flasks, which are used in the molding line (flasks only, excluding the frame 5), goes into and comes out of the molding machine.

A lifter table 10 is disposed below the filling frame 5. The lifter table 10 includes a cylinder 11 by which it is vertically moved. The lifter table 10 is mounted on a turntable 21 (which is shown in dotted lines in FIG. 1). When a master plate or carrier plate 9, which has a pattern 8 on it, and a flask 7, are put on the lifter table 10, the turntable 21 is rotated such that the lifter table 10 is located at a flask-setting station (not shown). At the station a master plate 9 is set on the lifter table 10, and a flask 7 is then set on the master plate 9. Then molding sand 12 is put in the flask 7. After this, by rotating the turntable 21 to its original position the lifter table 10 is returned to its original position shown in FIG. 1. FIG. 1 shows the state wherein the setting of the flask 7 has been completed. Since the cylinder 11 is retracted, the lifter table 10 is in its lower position.

FIG. 2 shows the operation of the molding machine to produce a mold. First, by extending the cylinder 11 the lifter table 10 is moved up from the lower position shown in FIG. 1 to the upper position shown in FIG. 2. Thus the flask 7 is lifted. When it is lifted, it fits into the reinforcing frame 5 and pushes it up against the filling frame 4, thereby pressing the filling frame 4 against the fixedly mounted, cover-like member 1. Thus a closed space is defined by the member 1 and the filling frame 4. Then pressurized air is introduced, for example, from an airflow and press molding machine, into the space through the pipes 2 (as shown by arrows), to thereby compact the molding sand 12 held in the flask 7. Or the squeeze board 3 of a mechanical-squeezing-type molding machine is pressed against the molding sand 12 to compact it. Both pressurized air and the squeeze board 3 may be used.

Since the rigid reinforcing frame 5 fittingly holds the flask 7, the flask is not deformed even when it is subjected to a force inside it.

The fitting mechanism of the reinforcing frame 5 and flask 7 has an advantage in that only the use of a cylinder 11 is needed, and no other actuator is needed. Further, when this mechanism is used, the degree of the reinforcing frame 5 to be fittingly pressed against the flask 7 can be controlled within a proper range by using the reaction force of the cushion pad 6.

Figure 3:
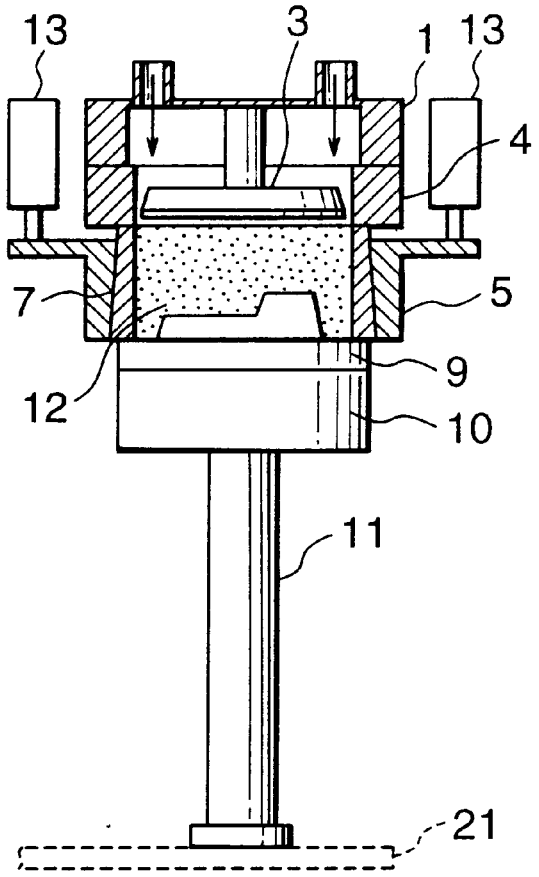
FIG. 3 is a cross-sectional view of a molding machine of an embodiment of the present invention, wherein it includes cylinders to move a reinforcing frame vertically.

FIG. 3 shows a second embodiment, wherein a plurality of cylinders 13 are attached to the reinforcing frame 5 of the first embodiment for vertically moving it. In this embodiment, the flask 7 is raised by the cylinder 11, and it is pressed against the bottom of the filling frame 4. When the flask 7 is pressed against the filling frame, the cylinders 13, 13 are activated to move the reinforcing frame 5 downward, thereby fitting it onto the flask 7. The advantage of this mechanism is that by controlling the output of the cylinders 13, 13, the degree to which the reinforcing frame 5 is to be fit on the flask 7 can be varied as desired. That is, the force of the reinforcing frame 5 to hold the flask 7 can be controlled. Further, since the timing to enable the frame 5 to act on the flask 7 can be controlled, the release of the frame 5 from the flask 7 may be selectively carried out either before or after the flask is removed from the mold.

Figure 4:
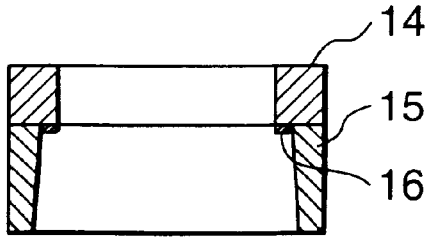
FIG. 4 is a cross-sectional view of a filling frame and a reinforcing frame, wherein the reinforcing frame is fixedly attached to the bottom of the filling frame.

FIG. 4 shows a third embodiment, where the reinforcing frame 5 of FIG. 1 is fixedly attached to the bottom of the filling frame 4 of FIG. 1, thereby forming an integral assembly of a filling frame 14 and a reinforcing frame 15. This assembly of the filling frame 14 and the reinforcing frame 15 is simple, and it may be used in the molding machine of the first embodiment (shown in FIGS. 1 and 2) to reinforce the flask 7. A seal 16 may be attached to the stepped part located between the frames 14 and 15. This seal 16 is preferably able to be greatly deformed such that no space occurs between it and the flask 7 when they meet.

Figure 5:
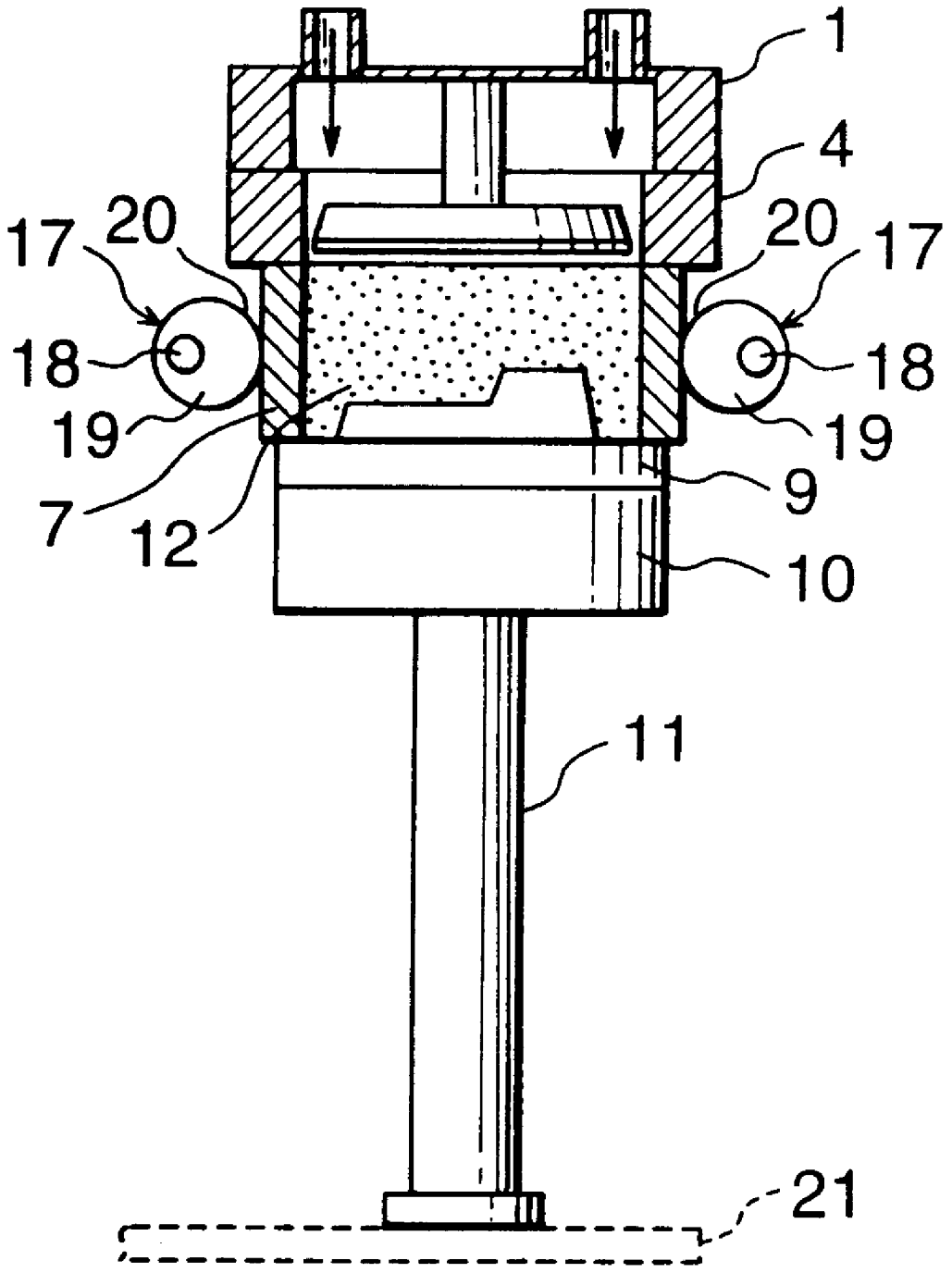
FIG. 5 is a cross-sectional view of a molding machine, wherein cams are used to hold the outer surfaces of the flask.

FIG. 5 shows a fourth embodiment, where a plurality of holding (or reinforcing) means 17, 17 are used instead of the reinforcing frame 5 of FIG. 1 or FIG. 3. The holding means are supported by the frame (not shown) and disposed outside the flask 7 for holding it and preventing it from being deformed. Each holding means 17 includes a shaft 18 (that is, cam), which may be rotated by a stepping motor (not shown), and a cam follower 19 fixedly mounted on the shaft 18. The cam follower 19 has a round, eccentric surface 20, which contacts and holds the flask 7 or which recedes from it when the cam shaft 18 is stepped (that is, when it is rotated and stopped) to a desired position. FIG. 5 shows the eccentric surfaces 20 of the cam followers 19, 19 contacting and holding the outer surfaces of the flask 7, thereby preventing it from being deformed when it is subjected to the force inside it.

The forces that are caused by compacting the molding sand 12 held in the flask 7, and that act on the round surfaces 20 of the cam followers 19, 19, are directed normal to the round surfaces. Thus the forces pass the shafts 18, 18 of the reinforcing means 17, 17, and they are not directed such as to rotate the round surface.

Alternatively, cylinders may be used to hold the outer surfaces of the flask 7. When such cylinders are used, and if their forces are applied to the flask when forces are not yet caused in the flask because molding sand held in it is not yet compacted, the flask will be deformed. Thus the forces to be imparted by such cylinders must be applied to the flask when forces are caused inside the flask. However, to do so is substantially impossible. Accordingly, when cylinders are used, the flask must be held by them with the minimum force that they can apply before forces due to the compaction of molding sand are caused in the flask, and the fluid in the cylinder acting to press the flask must not move.

The embodiments described above are exemplary only, and the scope of the invention is not limited to them. As will be clear to one skilled in the art, any variation can be made to them without departing from the attached claims.

What is claimed is:

1. A molding machine that compacts molding sand by applying a mechanical external force to the molding sand comprising:

a flask for receiving the molding, sand therein, said flask having an inclined vertical external surface; and a rigid frame having an inclined vertical inner surface corresponding to said inclined vertical external surface of said flask, said rigid frame being movable alongside said flask such that the inner surface of said rigid frame fits on the inclined vertical external surface of said flask to reinforce substantially the entire inclined vertical external surface of said flask at least when the mechanical external force is exerted on the molding sand in said flask.

2. The molding machine of claim 1, further comprising a lifter table for lifting said flask such that said rigid frame fits on said flask.

3. The molding, machine of claim 2, wherein said flask includes a filling frame integrally mounted on said flask.

* * * * *